US009993040B2

(12) United States Patent
Schreiber, Sr.

(10) Patent No.: US 9,993,040 B2
(45) Date of Patent: Jun. 12, 2018

(54) DETACHABLE SWEAT ABSORBING LINER

(71) Applicant: Richard William Schreiber, Sr., Scottsdale, AZ (US)

(72) Inventor: Richard William Schreiber, Sr., Scottsdale, AZ (US)

( * ) Notice: Subject to any disclaimer, the term of this patent is extended or adjusted under 35 U.S.C. 154(b) by 975 days.

(21) Appl. No.: 14/143,545

(22) Filed: Dec. 30, 2013

(65) Prior Publication Data

US 2014/0259262 A1 Sep. 18, 2014

Related U.S. Application Data

(60) Provisional application No. 61/789,501, filed on Mar. 15, 2013.

(51) Int. Cl.

| | |
|---|---|
| ***A41D 27/02*** | (2006.01) |
| ***A41D 27/12*** | (2006.01) |
| ***A41D 27/16*** | (2006.01) |
| ***A42C 5/02*** | (2006.01) |
| ***A41B 3/18*** | (2006.01) |

(52) U.S. Cl.
CPC ..... *A41D 27/16* (2013.01); *A41B 3/18* (2013.01)

(58) Field of Classification Search
CPC ..... A41D 27/16; A41D 27/18; A41D 27/12; A41D 27/13; A41D 27/14; A41B 3/18; A41B 3/04
USPC ..... 2/46, 60, 129, 181.4, 272
See application file for complete search history.

(56) References Cited

U.S. PATENT DOCUMENTS

| | | | | |
|---|---|---|---|---|
| 4,008,494 | A * | 2/1977 | Hicks | A41D 27/16 2/60 |
| 4,653,119 | A * | 3/1987 | Kaiser | A41B 3/18 2/60 |
| 4,989,269 | A * | 2/1991 | Takasugi | A41B 3/18 2/116 |
| 5,014,360 | A * | 5/1991 | Smith | A41D 13/0015 2/115 |
| 5,940,882 | A * | 8/1999 | Auguste | A41D 27/16 2/129 |
| 5,978,969 | A * | 11/1999 | Vinding Diers | A42B 3/10 2/181.4 |
| 6,105,166 | A * | 8/2000 | Thomas, III | A41D 27/16 2/132 |
| 2003/0093850 | A1* | 5/2003 | Peterkin | A41D 27/16 2/60 |
| 2003/0221236 | A1* | 12/2003 | Hippensteel | A42C 5/02 2/46 |
| 2004/0098785 | A1* | 5/2004 | Pennington | A41D 27/16 2/115 |

(Continued)

FOREIGN PATENT DOCUMENTS

| | | | | |
|---|---|---|---|---|
| CA | 2261533 | A1 * | 8/2000 | A41D 27/16 |
| FR | 2628945 | A1 * | 9/1989 | A41B 3/04 |

(Continued)

*Primary Examiner* — Jameson Collier

(57) ABSTRACT

A detachable sweat absorbing liner system has left and right sweat absorbing liners. The left and right sweat absorbing liners are removably attachable to inner frontal left and right necklines of an upper garment by left and right fasteners, respectively. The left and right sweat absorbing liners each has a moisture-sensitive medication. The moisture-sensitive medication protects and improves a user's facial area upon the use of the left and right sweat absorbing liners.

3 Claims, 10 Drawing Sheets

(56) References Cited

U.S. PATENT DOCUMENTS

| | | | | |
|---|---|---|---|---|
| 2005/0066408 | A1* | 3/2005 | Varela | A41D 27/12 2/69 |
| 2006/0150294 | A1* | 7/2006 | Yanamadala | A41D 27/13 2/53 |
| 2008/0229472 | A1* | 9/2008 | Maggs | A41B 3/18 2/60 |
| 2008/0244804 | A1* | 10/2008 | Lawrence | A41D 27/12 2/53 |
| 2008/0301848 | A1* | 12/2008 | Smith | A41D 27/16 2/60 |
| 2009/0241242 | A1* | 10/2009 | Beatty | A45D 44/002 2/206 |
| 2010/0199401 | A1* | 8/2010 | Whitfield | A41D 27/16 2/60 |
| 2011/0010817 | A1* | 1/2011 | Theberge | A43B 1/0045 2/69 |
| 2011/0296579 | A1* | 12/2011 | Galvan | A42C 5/02 2/60 |
| 2013/0244121 | A1* | 9/2013 | Gogotsi | H01M 4/583 429/338 |
| 2014/0041093 | A1* | 2/2014 | Korobkin | A41D 27/16 2/60 |
| 2014/0201882 | A1* | 7/2014 | Everhart | A61K 8/0208 2/69 |

FOREIGN PATENT DOCUMENTS

| | | | | |
|---|---|---|---|---|
| FR | 2758947 | A1 * | 8/1998 | A41B 3/18 |
| WO | WO 2004052130 | A1 * | 6/2004 | A41B 3/18 |

* cited by examiner

DETACHABLE SWEAT ABSORBING LINER

The current application claims a priority to the U.S. Provisional Patent application Ser. No. 61/789,501 filed on Mar. 15, 2013.

FIELD OF THE INVENTION

The present invention relates generally to absorbent materials used with articles of clothing. More specifically, the present invention is a reusable or replaceable sweat absorbing liner that is removably attached to the inside of an article of clothing around the neckline.

BACKGROUND OF THE INVENTION

The act of sweating is a natural process carried out by the human body and is primarily a means of thermoregulation. When an individual perspires, drops of sweat form on the surface of their skin. These drops of sweat then evaporate which in turn creates a cooling effect. In this way, the act of sweating prevents an individual's body from overheating due to exertion or from environmental temperatures. Adults have been found to have maximum sweat rates of up to 2-4 liters per hour. Sweat rates of this magnitude can most commonly be seen in athletics, where individuals are pushing their bodies to maximum exertion. While this sweat aids in cooling an athlete's body it can become a problem and an inconvenience to their performance. Sweat can get in an athlete's eye causing temporary blindness or distraction which can prove disastrous while in the middle of competition. As such, athletes are often found wiping their face and forehead with portions of their jersey, commonly the inner neckline. In other instances, such as basketball, sweat on the court can cause an athlete to slip resulting in injury to the athlete. For this reason, attendants are hired specifically to clean up sweat on a basketball court during stoppage times. Sweatbands have been developed, which are worn on a user's head or wrists, in order to absorb sweat from an individual's body, however, they are not always desirable due to comfort, appearance, etc. In some sports leagues, the use of sweatbands may even be prohibited.

Therefore it is the object of the present invention to provide a sweat absorbing material that is worn on the inside of an individual's article of clothing. A pair of sweat absorbing liners of the present invention is designed such that it is removably attached to the inside of an individual's article of clothing around the neckline. The pair of sweat absorbing liners is also designed such that it can be reused or disposed of after use. The pair of sweat absorbing liners also acts to provide a layer of padding, as some sections of clothing may irritate an individual's skin when the individual sweats. In particular the neckline of an athletic jersey often irritates the chest and neck area of an athlete. In this way, the pair of sweat absorbing liners provides additional comfort to the user.

DETAIL DESCRIPTIONS OF THE INVENTION

All illustrations of the drawings are for the purpose of describing selected versions of the present invention and are not intended to limit the scope of the present invention.

The present invention is a detachable sweat absorbing liner, where the detachable sweat absorbing liner comprises a left sweat absorbing liner 3, a right sweat absorbing liner 4, and a moisture-sensitive medication 7. In the preferred embodiment of the present invention, the left sweat absorbing liner 3 and the right sweat absorbing liner 4 are positioned along an inner frontal neckline of an upper garment; however, they may also be positioned along an outer frontal neckline of the upper garment as well. Although the left sweat absorbing liner 3 and the right sweat absorbing liner 4 are used in conjunction with athletic jerseys in the preferred embodiment of the present invention, the present invention can also be used with any other type of shirt or any other article of clothing, where the present invention can be designed in any size, shape and color.

Figure 1:
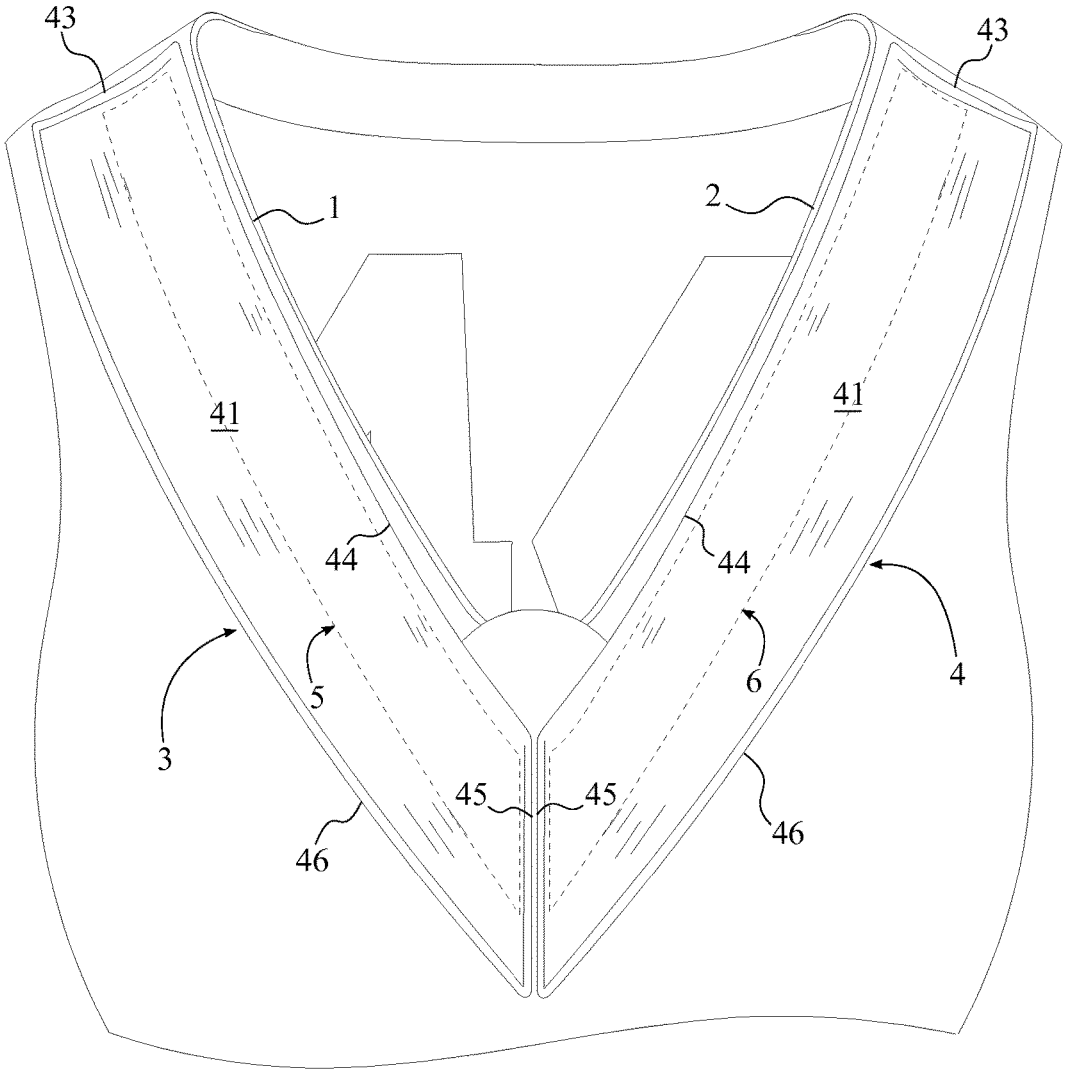
FIG. 1 is a view of the preferred embodiment of the present invention, wherein the present invention is attached to the inner frontal neckline of an athletic jersey and the dash lines illustrate the left and right fastening mechanisms.
Figure 3:
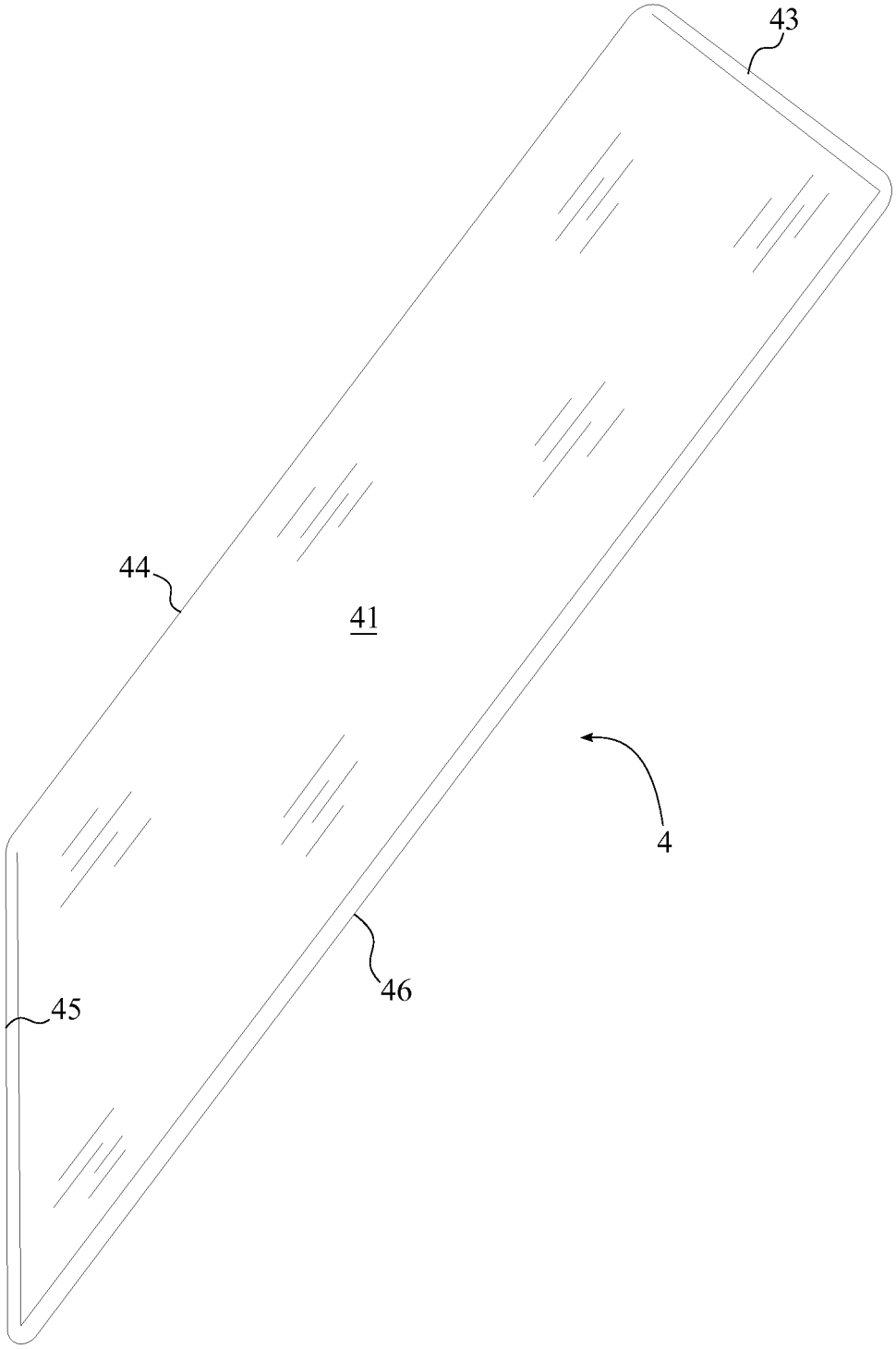
FIG. 3 is a top elevational view of the right sweat absorbing liner of the preferred embodiment of the present invention, illustrating the outer face.
Figure 5:
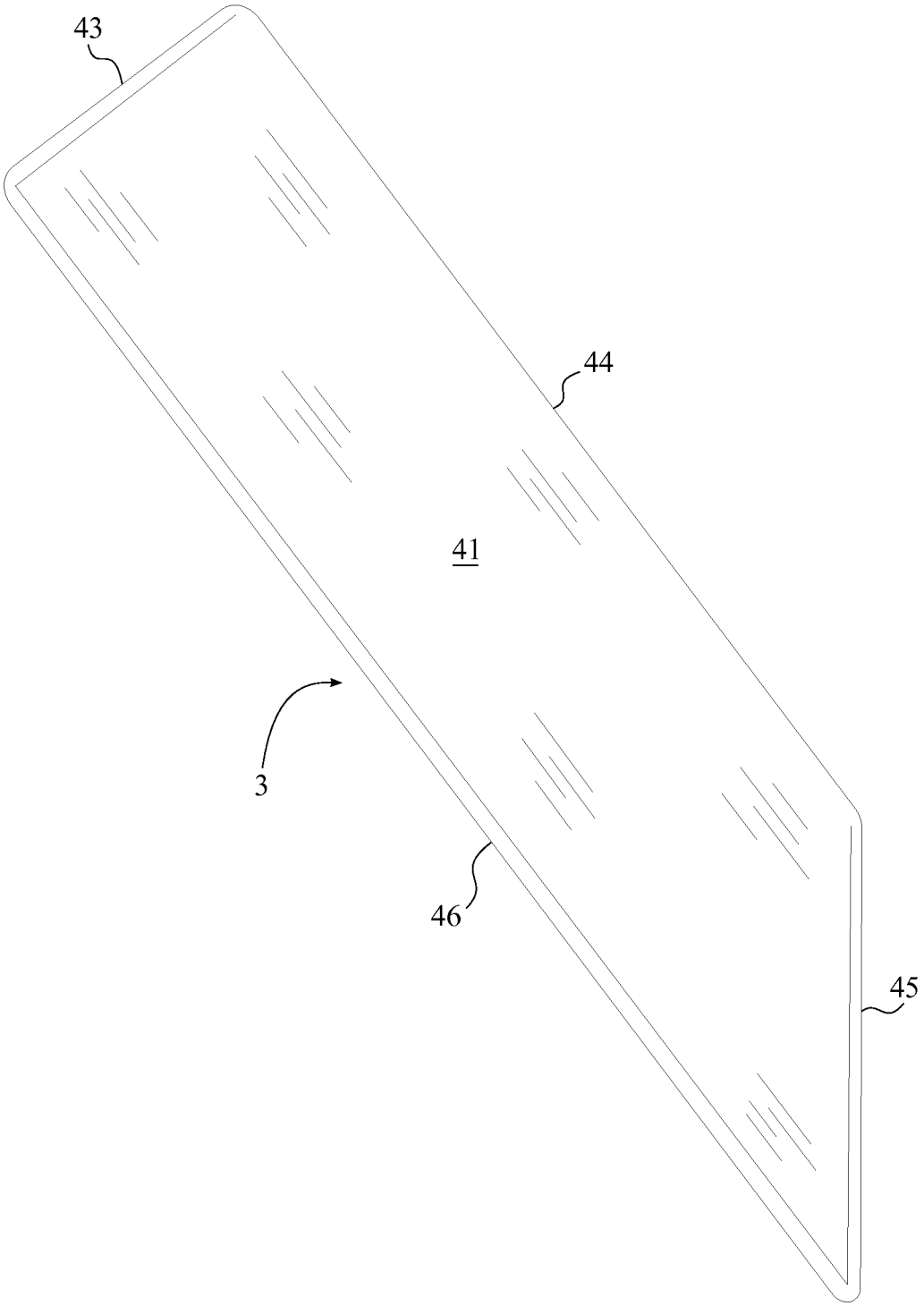
FIG. 5 is a top elevational view of the left sweat absorbing liner of the preferred embodiment of the present invention, illustrating the outer face.

In reference to FIG. 1, FIG. 3, and FIG. 5, the left sweat absorbing liner 3 and the right sweat absorbing liner 4 each comprise an outer face 41, an inner face 42, a shoulder edge 43, a proximal edge 44, a vertical edge 45, and a distal edge 46. The outer face 41 and the inner face 42 are oppositely positioned from each other on the left sweat absorbing liner 3 and the right sweat absorbing liner 4. The outer face 41 generally positions adjacent with the user's body while the inner face 42 generally positions adjacent with the inner frontal neckline. The shoulder edge 43, the proximal edge 44, the vertical edge 45, and the distal edge 46 are perimetrically positioned around the left sweat absorbing liner 3 and the right sweat absorbing liner 4. More specifically, the shoulder edge 43 and the vertical edge 45 are positioned in between the proximal edge 44 and the distal edge 46 in such way that the shoulder edge 43 and the vertical edge 45 are oppositely positioned from each other along the proximal edge 44 and the distal edge 46. The body of the left sweat absorbing liner 3 and the right sweat absorbing liner 4 is preferably completed with a layered material in the preferred embodiment. More specifically, the layered material provides a smooth surface adjacent to the proximal edge 44 and is connected together within the shoulder edge 43, the vertical edge 45, and the distal edge 46.

Figure 2:
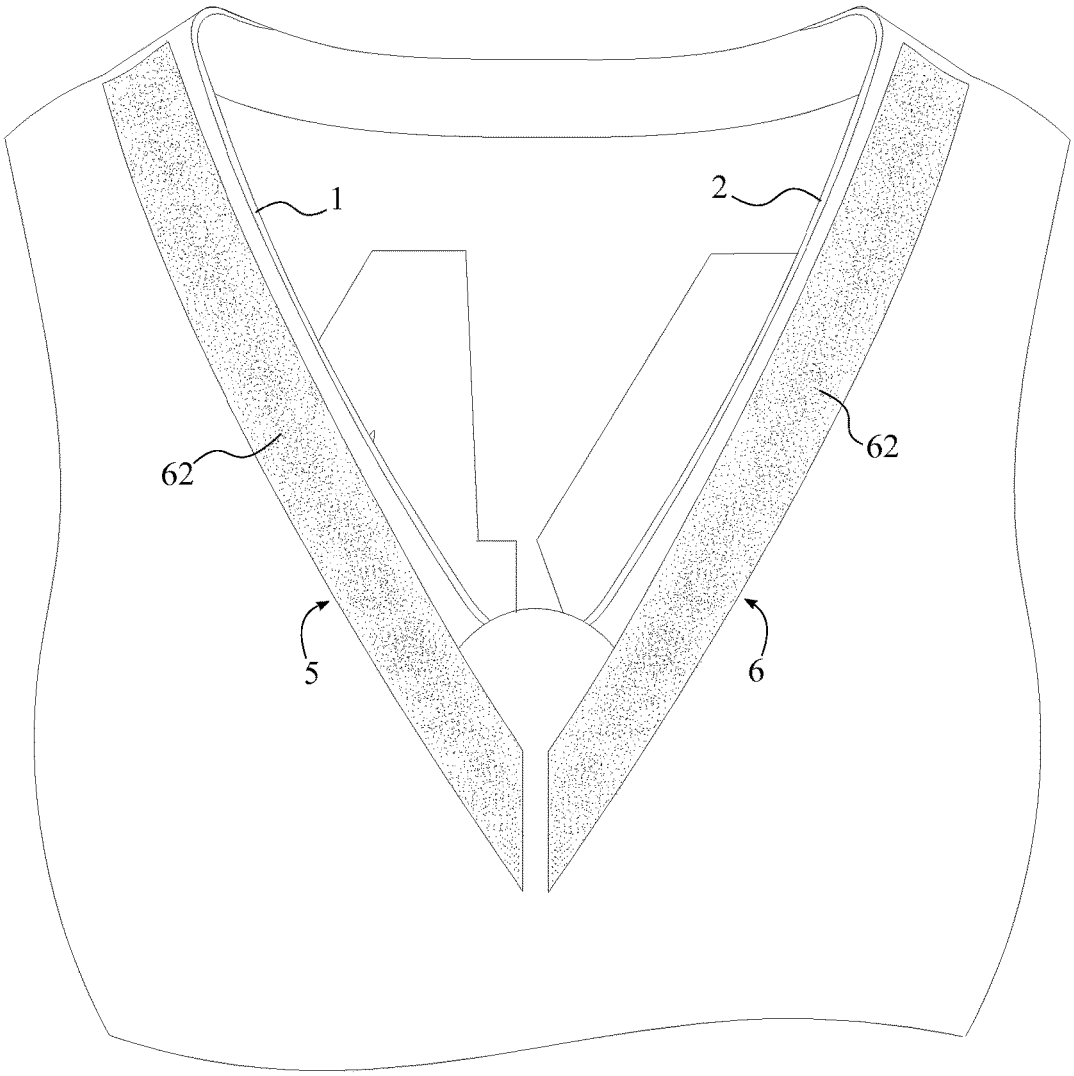
FIG. 2 is a view of the inner frontal neckline of an athletic jersey, showing the loop portions of the left and right fastening mechanisms.

In reference to FIG. 1 and FIG. 2, the left sweat absorbing liner 3 is removably attached with an inner frontal left neckline 1 of the upper garment by a left fastening mechanism 5. Similarly, the right sweat absorbing liner 4 is removably attached with an inner frontal right neckline 2 of the upper garment by a right fastening mechanism 6. More specifically, the left fastening mechanism 5 is positioned in between the inner face 42 of the left sweat absorbing liner 3 and the inner frontal left neckline 1, and the right fastening mechanism 6 is positioned in between the inner face 42 of the right sweat absorbing liner 4 and the inner frontal right neckline 2. The left fastening mechanism 5 and the right fastening mechanism 6, which create a temporary and secured attachment, allow the left sweat absorbing liner 3 and the right sweat absorbing liner 4 to be attached or detached from an athletic jersey on an as needed or as wanted basis. For example, athletes may choose to replace the left sweat absorbing liner 3 and the right sweat absorbing liner 4 during the stoppage time during competition as the left sweat absorbing liner 3 and the right sweat absorbing liner 4 can be respectively removed and attached through the left fastening mechanism 5 and the right fastening mechanism 6.

Figure 4:
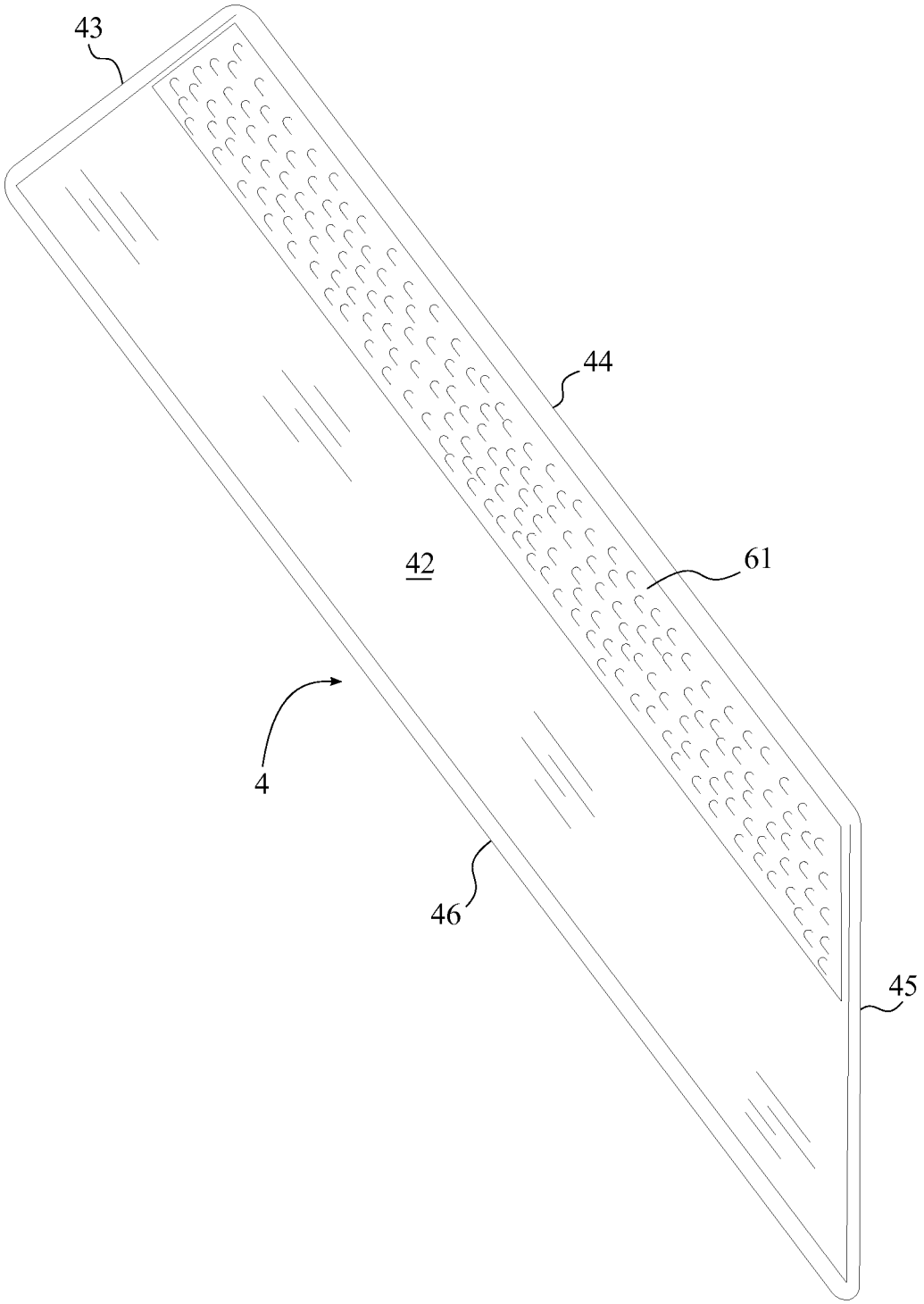
FIG. 4 is a top elevational view of the right sweat absorbing liner of the preferred embodiment of the present invention shown in FIG. 3, illustrating the inner face and the hook portion.
Figure 6:
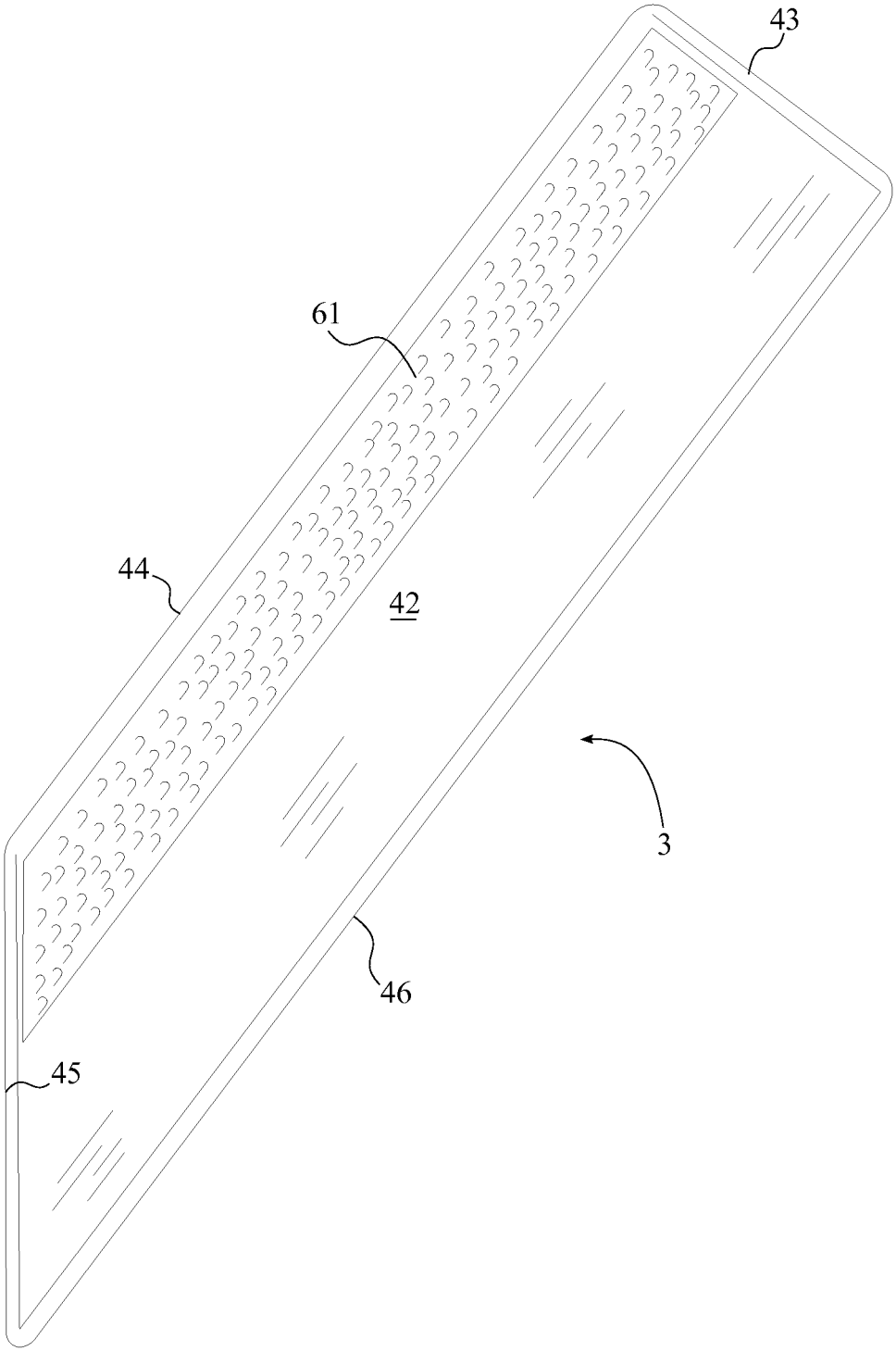
FIG. 6 is a top elevational view of the left sweat absorbing liner of the preferred embodiment of the present invention shown in FIG. 5, illustrating the inner face and the hook portion.

In reference to FIG. 4 and FIG. 6, the left fastening mechanism 5 and the right fastening mechanism 6 each comprise a hook portion 61 and a loop portion 62, where the hook portion 61 and the loop portion 62 attach with each other in order to create the left fastening mechanism 5 and the right fastening mechanism 6. More specifically, the hook portion 61 of the left fastening mechanism 5 is permanently connected with the inner face 42 of the left sweat absorbing liner 3, where the hook portion 61 of the left fastening mechanism 5 is adjacently positioned along the proximal edge 44 of the left sweat absorbing liner 3. The loop portion 62 of the left fastening mechanism 5 is permanently connected with the inner frontal left neckline 1. Similarly, the hook portion 61 of the right fastening mechanism 6 is permanently connected with the inner face 42 of the right sweat absorbing liner 4, where the hook portion 61 of the right fastening mechanism 6 is adjacently positioned along the proximal edge 44 of the right sweat absorbing liner 4. The loop portion 62 of the right fastening mechanism 6 is permanently connected with the inner frontal right neckline 2. As loop portions 62 are soft, as opposed to the rough hook portions 61, the attached upper garment can still be comfortably worn by the users without left sweat absorbing liner 3 and the right sweat absorbing liner 4.

The hook portion 61 of the left fastening mechanism 5 and the right fastening mechanism 6 can be connected with the inner faces 42 by either stitch lines, heat activated glue, or pressure sensitive glue. The stitch lines are used as the prefabricated method to connect the hook portions 61 while the heat activated glue and the pressure sensitive glue allow the users of the present invention to connect the hook portions 61 with the inner faces 42. The loop portion 62 of the left fastening mechanism 5 and the right fastening mechanism 6 can be respectively connected with the inner frontal left neckline 1 and the inner frontal right neckline 2 by either the heat activated glue or the pressure sensitive glue as the heat activated glue and the pressure sensitive glue allow the users of the present invention to connect the loop portions 62 with any desired upper garment. In the preferred embodiment, the hook portions 61 and the loop portions 62 utilize the pressure sensitive glue, where the pressure sensitive glue creates a permanent chemical bond with the inner frontal left neckline 1 and the inner frontal right neckline 2 as the pressure is applied to the hook portions 61 and the loop portions 62. More specifically, when the pressure is applied to an adhesive side of each of the hook portions 61 and the loop portions 62, the adhesive side forms the permanent chemical bond within the inner frontal left neckline 1 and the inner frontal right neckline 2. In the method of heat activated glue, each of the hook portions 61 and the loop portions 62 comprise an adhesive side which is respectively positioned adjacent to the inner faces 42 and the inner frontal neckline. Heat is then directly applied from a heat source, such as a steam iron, to the side of the athletic jersey opposite from the loop portions 62 and to the outer faces 41 of the left sweat absorbing liner 3 and the right sweat absorbing liner 4 opposite from the hook portions 61 in order to form a permanent bond.

Figure 7:
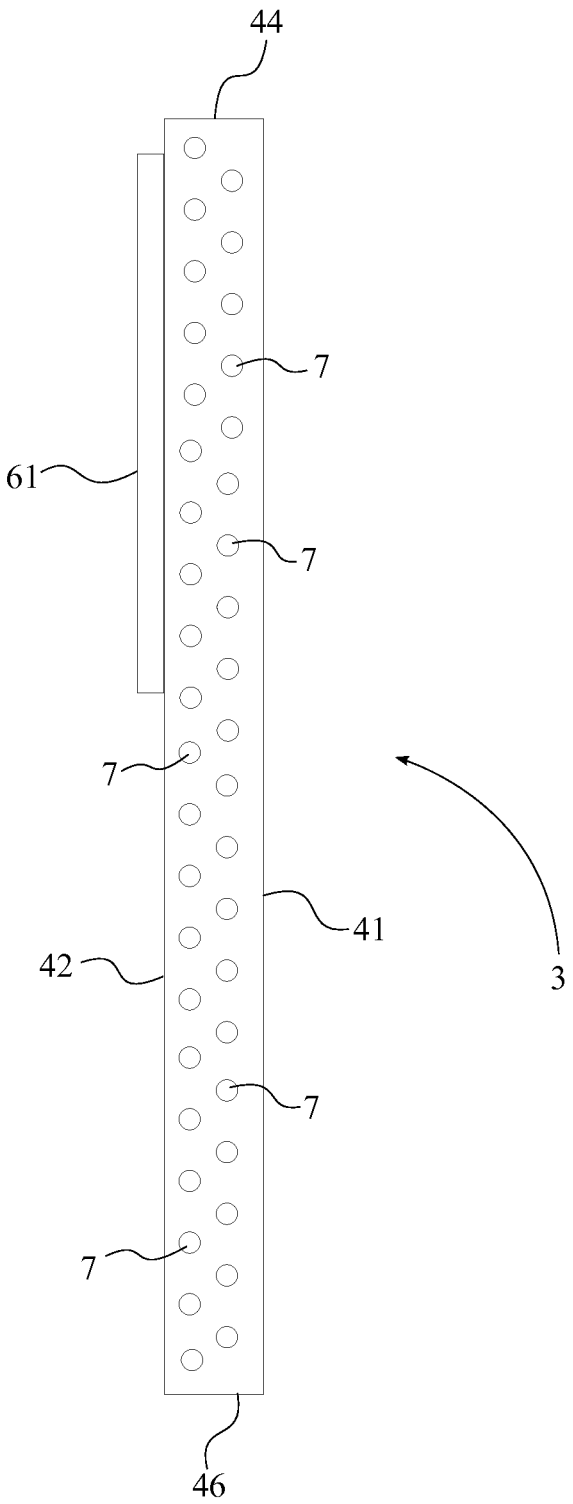
FIG. 7 is cross section view of the left sweat absorbing liner, showing the moisture-sensitive medication.
Figure 8:
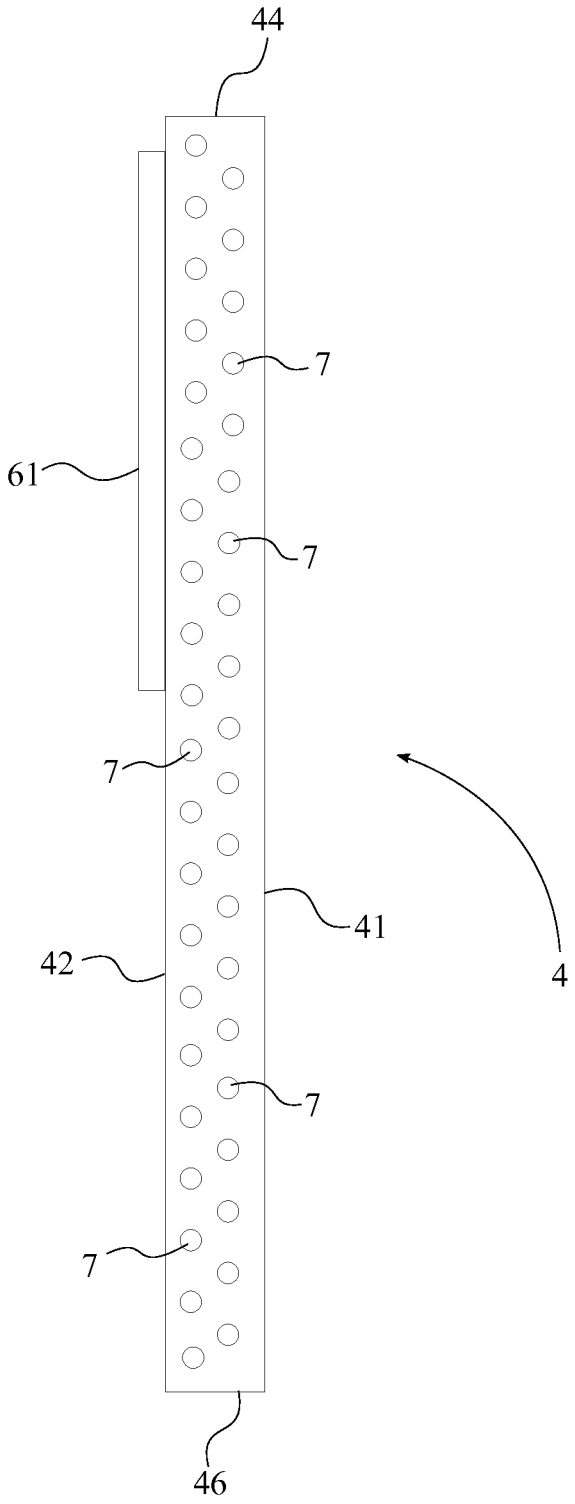
FIG. 8 is cross section view of the right sweat absorbing liner, showing the moisture-sensitive medication.

In reference to FIG. 7 and FIG. 8, the sweat of the user activates the moisture-sensitive medication 7 when the left sweat absorbing liner 3 or the right sweat absorbing liner 4 is wiped across a user's skin. More specifically, the moisture-sensitive medication 7 is retained by the left sweat absorbing liner 3 and the right sweat absorbing liner 4 until the moisture-sensitive medication 7 is activated by the sweat. The moisture-sensitive medication 7 can be any type of medication 7 such as benzoyl peroxide to fight acne or a moisturizer to aid in dry skin. This is particularly useful as oftentimes athletes who have acne, dry skin or otherwise sensitive skin on regions of their face. By constantly rubbing their jersey across their face to remove sweat they are irritating this sensitive skin, resulting in accelerated breakouts, sores, discolored skin, etc. The moisture-sensitive medication 7 acts to resolve these issues and allows for a healthier skin. It may be possible to apply additional moisture-sensitive medication 7 to the left sweat absorbing liner 3 and the right sweat absorbing liner 4 once the original dosage has been used. This additional moisture-sensitive medication 7 can be provided in a separate container such that the moisture-sensitive medication 7 can be applied as needed.

In the preferred embodiment of the present invention the left sweat absorbing liner 3 and the right sweat absorbing liner 4 are constructed from a fabric that is preferably 55% hemp and 45% cotton; however, it is possible for any other ratio of hemp to cotton to be used within the present invention. A hemp and cotton blend is desired as hemp is stronger, more durable and more absorbent than cotton. Additionally, hemp has a natural antibacterial property, which is ideal for contact sports where sweat may be transferred from one athlete to another. It is also possible for any other materials or combination of materials to be used to construct the left sweat absorbing liner 3 and the right sweat absorbing liner 4.

While the left sweat absorbing liner 3 and the right sweat absorbing liner 4 may be left attached to an athletic jersey and laundered together, they may also be removed and separately laundered if desired. Additionally, the left sweat absorbing liner 3 and the right sweat absorbing liner 4 can be removed and disposed of after use so that a new replacement set of left sweat absorbing liner 3 and the right sweat absorbing liner 4 can be attached.

Figure 9:
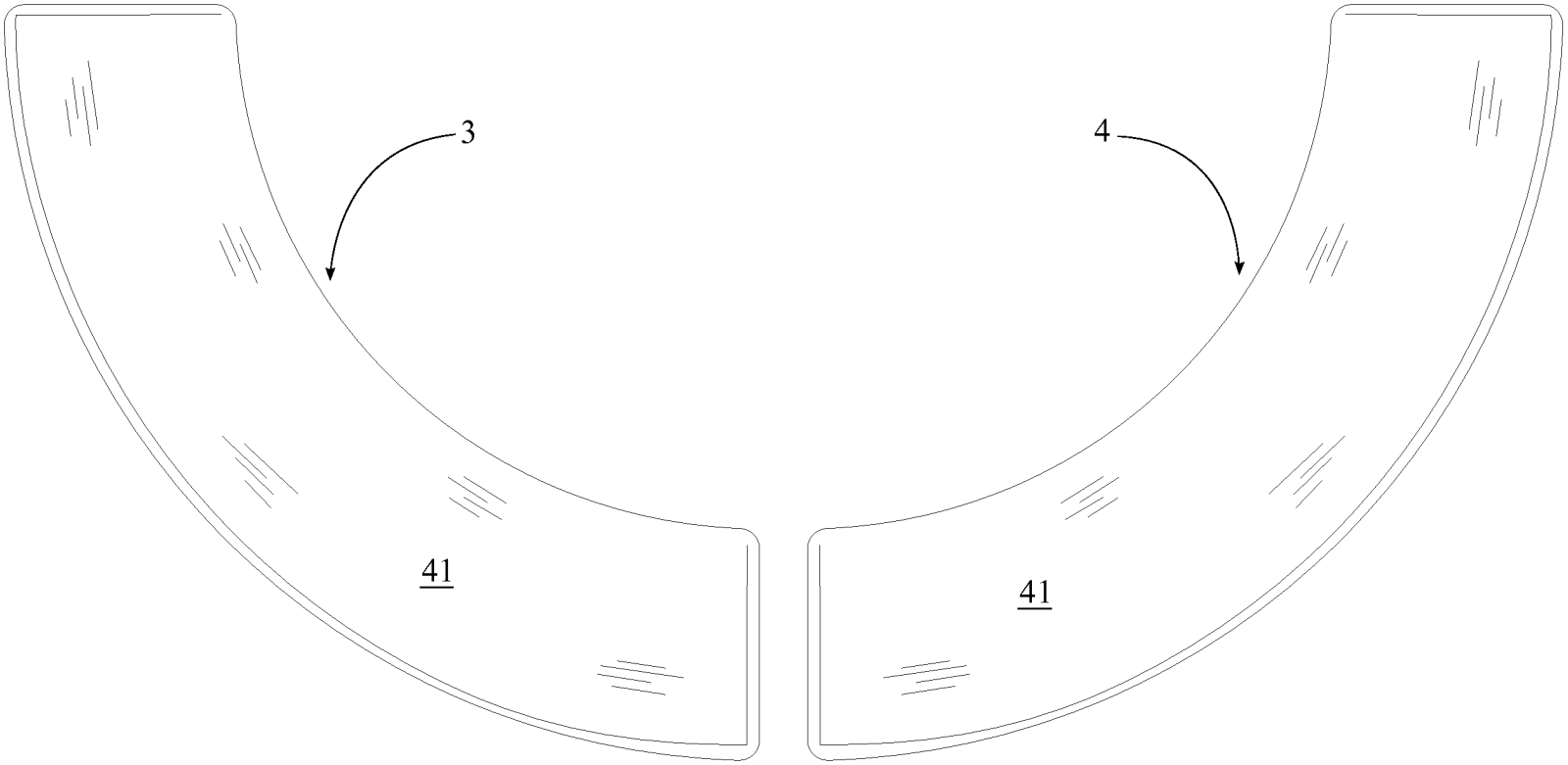
FIG. 9 is a top elevational view of one of the pair of sweat absorbing pads in an alternative embodiment of the present invention.
Figure 10:
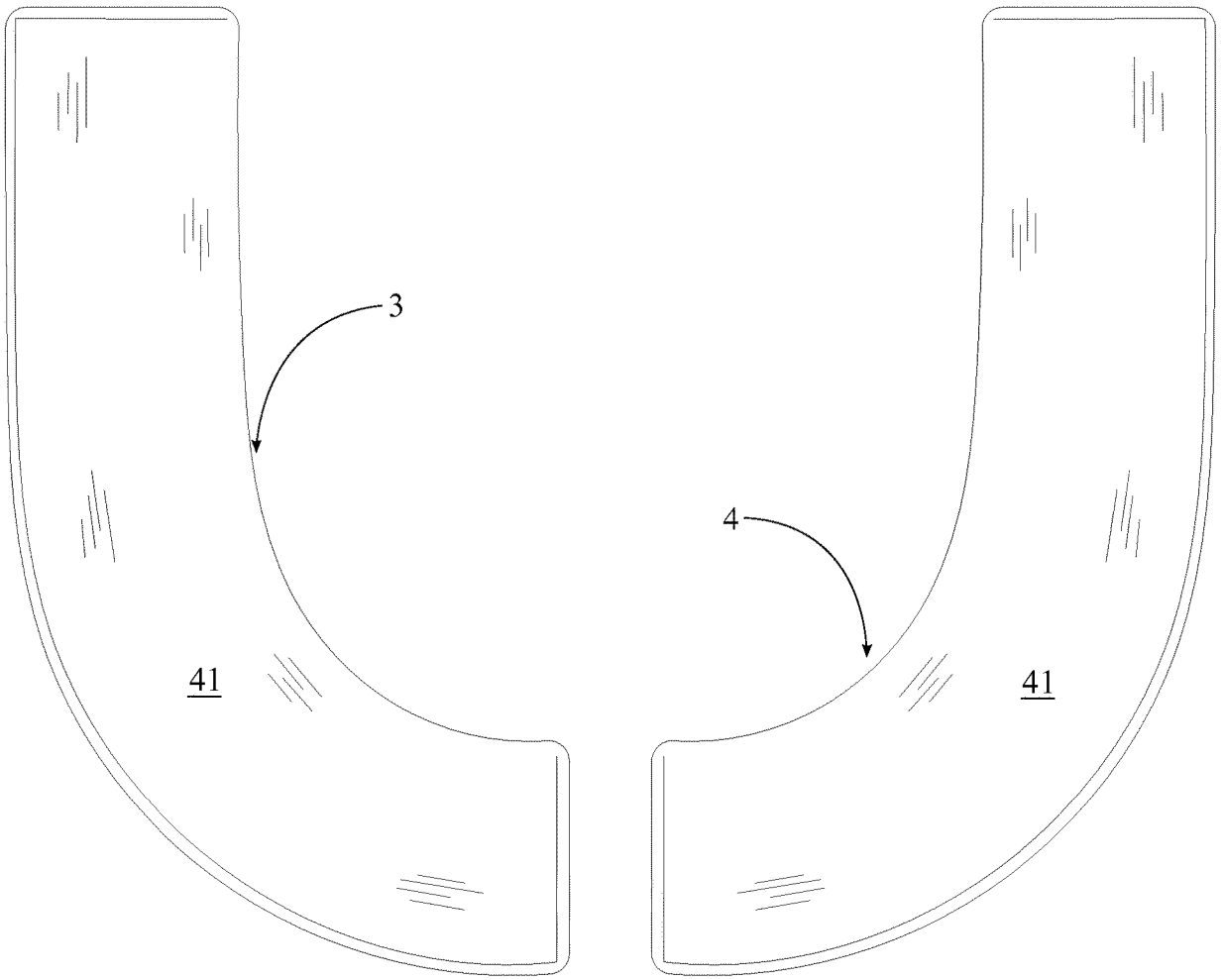
FIG. 10 is a top elevational view of one of the pair of sweat absorbing pads in another alternative embodiment of the present invention.

In reference to FIG. 9 and FIG. 10, the left sweat absorbing liner 3 and the right sweat absorbing liner 4 can have different shapes such that the left sweat absorbing liner 3 and the right sweat absorbing liner 4 are able to match the V-neck, the circular neck, or the square neck of an athletic jersey or any other upper garments. It is also possible for the left sweat absorbing liner 3 and the right sweat absorbing liner 4 to be designed in any other shapes as to fit other shaped jerseys or shirts.

In an alternative embodiment of the present invention, the left sweat absorbing liner 3 and the right sweat absorbing liner 4 may be combined into form a single sweat absorbing liner or further separated to form more than two sweat absorbing liner. In the same manner, the left fastening mechanism 5 and the right fastening mechanism 6 may be combined to form a single fastener or further separated to form more than two fasteners.

Although the invention has been explained in relation to its preferred embodiment, it is to be understood that many other possible modifications and variations can be made without departing from the spirit and scope of the invention as hereinafter claimed.

What is claimed is:

1. A detachable sweat absorbing liner system comprising:

an upper garment;

a left sweat absorbing liner;

a right sweat absorbing liner;

a moisture-sensitive medication;

a left fastener;

a right fastener;

the upper garment comprising an inner frontal left neckline and an inner frontal right neckline;

the left sweat absorbing liner and the right sweat absorbing liner each being constructed from a fabric material essentially consisting of 55% hemp and 45% cotton;

the left sweat absorbing liner and the right sweat absorbing liner each comprising an outer face, an inner face, a shoulder edge, a proximal edge, a vertical edge and a distal edge;

the outer face and the inner face being oppositely positioned from each other;

the shoulder edge, the proximal edge, the vertical edge and the distal edge of the left sweat absorbing liner being perimetrically positioned respectively around the left sweat absorbing liner;

the shoulder edge, the proximal edge, the vertical edge and the distal edge of the right sweat absorbing liner being perimetrically positioned respectively around the right sweat absorbing liner;

the left sweat absorbing liner being removably attachable to the inner frontal left neckline by the left fastener;

the right sweat absorbing liner being removably attachable to the inner frontal right neckline by the right fastener;

the left fastener being positioned in between the inner face of the left sweat absorbing liner and the inner frontal left neckline;

the right fastener being positioned in between the inner face of the right sweat absorbing liner and the inner frontal right neckline;

the left fastener and the right fastener each comprising a hook portion and a loop portion;

the loop portion being soft relative to the hook portion being rough;

the hook portion and the loop portion being removably attachable to each other;

the hook portion of the left fastener being permanently connected with the inner face of the left sweat absorbing liner;

the loop portion of the left fastener being permanently connected with the inner frontal left neckline;

the hook portion of the right fastener being permanently connected with the inner face of the right sweat absorbing liner;

the loop portion of the right fastener being permanently connected with the inner frontal right neckline;

the moisture-sensitive medication being retained by the left sweat absorbing liner and the right sweat absorbing liner;

the moisture-sensitive medication being configured to be activated by a-sweat; and the moisture-sensitive medication being a benzoyl peroxide.

2. The detachable sweat absorbing liner system as claimed in claim 1 comprising:

the hook portion of the left fastener being adjacently positioned along the proximal edge of left sweat absorbing liner.

3. The detachable sweat absorbing liner system as claimed in claim 1 comprising:

the hook portion of the right fastener being adjacently positioned along the proximal edge of right sweat absorbing liner.

* * * * *